US005387772A

United States Patent [19]

Bestel

[11] Patent Number: 5,387,772

[45] Date of Patent: Feb. 7, 1995

[54] VACUUM SWITCH

[75] Inventor: Ernest F. Bestel, West Allis, Wis.

[73] Assignee: Cooper Industries, Inc., Houston, Tex.

[21] Appl. No.: 146,526

[22] Filed: Nov. 1, 1993

[51] Int. Cl.[6] ..... H01H 33/66
[52] U.S. Cl. ..... 200/144 B
[58] Field of Search ..... 200/144 B

[56] References Cited

U.S. PATENT DOCUMENTS

| | | | |
|---|---|---|---|
| 2,981,813 | 4/1961 | Jennings | 200/144 R |
| 3,025,375 | 3/1962 | Frank | 200/144 R |
| 3,048,681 | 8/1962 | Polinko, Jr. | 200/144 R |
| 3,048,682 | 8/1962 | Veras | 200/144 R |
| 3,244,843 | 4/1966 | Ross | 200/144 B |
| 3,586,801 | 6/1971 | Salto et al. | 200/144 B |
| 3,777,089 | 12/1973 | Nitz | 200/144 B |
| 4,124,790 | 11/1978 | Kumbera et al. | 200/144 B |
| 4,150,270 | 4/1979 | Zunick | 200/144 B |
| 4,158,911 | 6/1979 | Polinko, Jr. et al. | 29/622 |
| 4,256,938 | 3/1981 | Efinger et al. | 200/144 B |
| 4,568,804 | 2/1986 | Luehring | 200/144 B |
| 4,871,888 | 10/1989 | Bestel | 200/144 B |

OTHER PUBLICATIONS

Robert L. Mann, *A Primary Transformer Protector Utilizing Encapsulated Vacuum Interrupters;* (4 pgs.); American Power Conference, Chicago, Illinois, Apr. 23–25, 1979.

Kyle Distribution Switchgear, McGraw–Edison Power Systems; *Protect Network Transformers with McGraw–Edison Fault Interrupters*; (8 pages); Mar. 1986.

*Primary Examiner*—J. R. Scott
*Attorney, Agent, or Firm*—David A. Rose

[57] ABSTRACT

The vacuum switch includes a ceramic and metal housing having a metal body portion with a generally T-shaped cross-section forming three ends. Ceramic insulators are brazed on each of the three ends with the insulators being closed by metal end members. A first end receives a stationary conductor with the opposite second end reciprocably receiving an actuator member. A second stationary conductor is disposed at the third end transversely of the axis of the first stationary conductor. The first conductor includes a stationary switch contact disposed on its terminal end. A moveable switch contact is disposed on the terminal end of the actuator member. The second stationary conductor includes a flexible cantilever beam extending therefrom and received within an aperture in the actuator member for the moveable switch contact. The flexible cantilever beam flexes between a closed circuit position when said moveable switch contact engages the stationary switch contact and an open circuit position when the moveable switch contact is out of engagement with the stationary switch contact.

12 Claims, 2 Drawing Sheets

VACUUM SWITCH

BACKGROUND OF THE ART

The invention relates generally to switches for interrupting the flow of electrical current in electrical circuits and, more particularly, to a new and improved vacuum switches for high-voltage circuits.

Vacuum switches are used in several different applications. A vacuum switch may be used for capacitor switching or for sectionalizing a line or system of switches. A vacuum switch may also be molded into a "load break" elbow connector to interrupt currents of medium voltage distribution systems. A vacuum switch may also be molded into a solid insulator or be used in a switch enclosure under oil. Typically, vacuum switches are employed as a high-voltage vacuum circuit interrupter.

Load break switches used in voltage power distribution range circuits are of four general types. Air break switches which rely on air for installation. Oil insulated switches where oil is both an insulator and an arc quenching medium. Another class of load break switches for distribution systems is gas insulated switches which employ gas for both insulation and interruption. Sulphur hexafluoride, either alone or mixed with other gases such as nitrogen, is used. Such switches can be of the gas-blast or puffer type in which the arc quenching gas is caused to flow across the contacts as the arc is formed.

The fourth class of load break switches employs vacuum interrupters. High-voltage vacuum-type circuit interrupters are well known in the art. As used herein, the term "high-voltage" means a voltage greater than 1,000 volts. In these switches, the contacts are enclosed in an evacuated chamber. The vacuum environment rapidly dissipates the gaseous products of the arc drawn between the contacts of the switch to effect interruption of the current when the switch is opened.

Typically, a vacuum circuit interrupter includes a pair of electrodes, one being stationary and the other movable between an open and closed position to open and close the circuit. Although vacuum circuit interrupters may be used in either a single-phase or three-phase system, they are commonly used in three-phase systems with three or multiples of three switches mounted in a common grounded metal enclosure. The enclosure includes an insulating medium which surrounds each vacuum interrupter. The insulating medium can be air, oil, or sulphur hexafluoride. U.S. Pat. Nos. 3,048,681; 3,048,682; 3,586,801; 3,777,089; and 4,158,911 illustrate vacuum circuit interrupters having opposed electrodes, one being stationary and the other being movable. Such patents also disclose metallic shields to shield portions of the interior of the envelope or housing of the interrupter from the metal on the electrodes which is vaporized upon the creation of the resulting are upon opening a gap between the electrodes to open the interrupter.

U.S. Pat. No. 4,568,804 discloses a high-voltage vacuum type circuit interrupter. The interrupter includes a ceramic insulating housing mounted on a metallic base and lower housing which includes an actuator. A vacuum module having a housing with an evacuated environment is disposed within the ceramic insulating housing and includes a pair of switch contacts. One switch contact is stationary and is electrically connected to a top or switch electrical terminal. The other contact is moveable and is electrically connected to a line terminal and electrical ground. A dielectric operating rod is connected to the moveable switch contact and to the actuator. The switch contacts are mounted within a metallic vapor shield. A metallic bellows is used to seal the lower moveable contact.

Another form of a vacuum switch is shown in U.S. Pat. No. 2,981,813. Two opposed stationary contact rods extend into a hermetically sealed and vacuumized envelope with a gap between the terminal ends thereof. A contact means in the form of a copper disk is mounted on an actuator shaft. The actuator shaft includes a dielectric post having one end affixed to the contact means and the other end affixed to a metallic rod extending through an expansible metallic bellows and through an aperture in the envelope for connection to a operating means for actuating the contact means. The dielectric post electrically insulates the contact means from the rod and bellows. One end of the bellows is hermetically sealed with the envelope and the other end is connected to the inner end portion of the rod. Both of the coaxial main contact rods are stationary.

High-voltage vacuum-type circuit interrupters and the individual components thereof have many varied and generally complex and expensive configurations. Typically, prior art interrupters include an actuator rod which moves one of the current carrying members to open and close the circuit. Thus, the moving electrode includes a current interchange from which it is difficult to dissipate the heat produced by the arcing and opening the circuit. Only the stationary contact tends to dissipate any major amount of heat. Further, in conventional interrupters, there is a great distance between line and ground which must be insulated. Sometimes the actuator rod can be as long as 20 inches for 27 kv voltage. Thus, a large line-to-ground insulation is required.

The present invention overcomes these deficiencies of the prior art.

SUMMARY OF THE INVENTION

The vacuum switch of the present invention includes a ceramic and metal housing having a metal body portion with a generally T-shaped cross-section forming three ends. Ceramic insulators are brazed on each of the three ends with the insulators being closed by metal end members. A first end receives a stationary conductor with the opposite second end reciprocably receiving an actuator member. A second stationary conductor or terminal is disposed transversely of the axis of the first stationary conductor at the third end.

The first conductor includes a stationary switch contact disposed on its terminal end. A movable switch contact is disposed on the terminal end of the actuator member. The second stationary conductor includes a flexible cantilever beam extending therefrom and received in an aperture in the actuator member for the movable switch contact. The flexible beam flexes between a closed circuit position when the movable switch contact engages the stationary switch contact and an open circuit position when the movable switch contact is out of engagement with the stationary switch contact.

The present invention is a multi-purpose vacuum switch for direct encapsulation or molding providing external insulation. The tube does not require any external moving current interchange and no external line to ground insulating push rod to operate the device. The mechanical and current and voltage carrying sections are separated by putting a line to ground insulating push rod inside the vacuum enclosure thus allowing size reduction and a greater reliability. In the present invention, both current carrying members are stationary and neither is part of a current interchange which prevents the dissipation of the heat caused by the arcing.

Further, in the present invention, the load terminal and feeder terminal may be directly connected to the line while the other side of the housing is ground level. Thus, the present invention does not require the line-to-ground insulation that is needed in conventional interrupters. The draw rod of the present invention is very short because it is disposed within the vacuum chamber. The bottom of the switch housing is actually a ground so that no large line-to-ground insulators are required. Such a construction also makes obsolete an extensive and complex mechanism for actuating the rod and contacts to open and close the interrupter.

Other objects and advantages of the present invention will appear from the following description.

BRIEF DESCRIPTION OF THE DRAWINGS

For a detailed description of a preferred embodiment of the invention, reference will now be made to the accompanying drawings wherein.

DETAILED DESCRIPTION OF A PREFERRED EMBODIMENT

Figure 1:
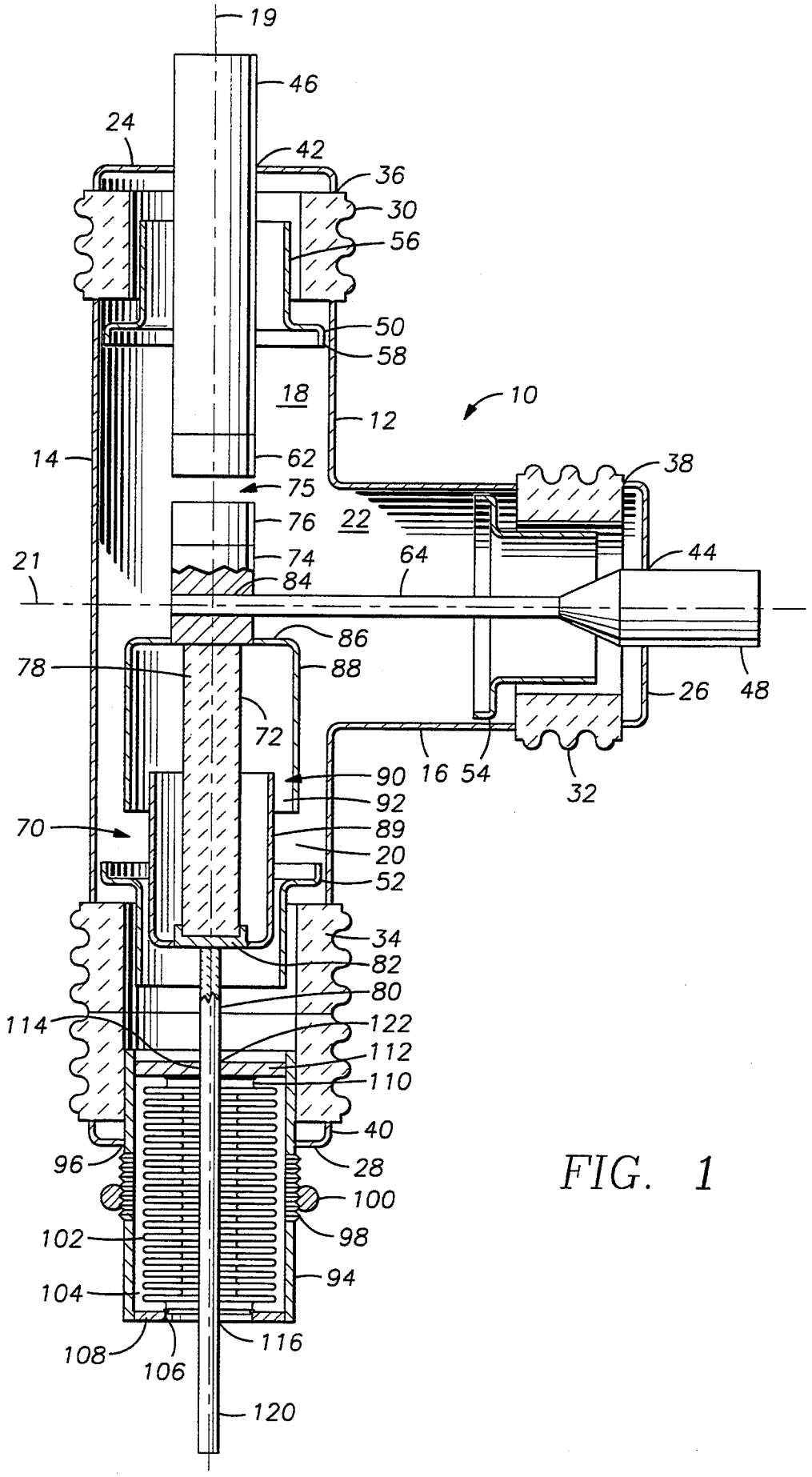
FIG. 1 is a cross-sectional elevation view of the vacuum switch of the present invention.

Referring initially to FIG. 1, the multi-purpose vacuum switch 10 of the present invention includes a floating, metal/ceramic enclosure 12 having a generally T-shaped cross-section composed of a cylindrical central housing 14 and a transverse, cylindrical side housing 16. The term "generally cylindrical" is used to mean that the housing is substantially cylindrical but not necessarily of circular cross-section. Other less preferred cross-sections may be employed, if desired. The cylindrical central housing 14 forms an upper cylindrical bore or chamber 18 and a lower cylindrical bore or chamber 20. The cylindrical side housing 16 forms a cylindrical bore or chamber 22. The axis 21 of bore 22 is transverse and preferably perpendicular to the axis 19 of bores 18, 20.

The primary body portions of central cylindrical housing 14 and side central housing 16 are made of metal, preferably stainless steel. Ceramic insulators 30, 32 and 34 closed by end covers or caps 24, 26 and 28, respectively, complete and hermetically seal upper chamber 18, side chamber 22, and lower chamber 20, respectively. As a dielectric, ceramic sections 30, 32 and 34 act as an insulator between the body portions of housing 14, 16 and end caps 24, 26 and 28. Aluminum oxide ceramic insulators 34 mounted adjacent lower cover 28 includes a pair of insulators. Ceramic insulators 30, 32 and 34 are ceramic cylindrical sections or collars affixed to the metal ends of cylindrical central housing 14 and cylindrical side housing 16 with end caps 24, 26 and 28, respectively being affixed to ceramic insulators 30, 32, and 34, respectively. Ceramic insulators 30, 32, and 34 are preferably made of aluminum oxide ($Al_2O_3$). Ceramic insulators 30, 32 and 34 are metallized with moly-manganese by high temperature firing in non oxidating atmosphere. The ceramic is then plated with nickel. The end caps 24, 26 and 28 are also metal, preferably stainless steel.

Ceramic insulators 30, 32 and 34 are affixed to the metallic body portions of central cylindrical housing 14 and side cylindrical housing 16 by brazing. The metal body portion and end caps are brazed to the metallized ceramic with a high temperature alloy. Any high-temperature alloy may be used as a suitable brazing alloy. The alloy is melded at the interface of the parts, like a solder, to form a vacuum, hermetic seal. A metal-ceramic seal 36, 38, and 40 are provided between caps 24, 26, 28 and insulators 30, 32, 34, respectively to hermetically seal enclosure 12. Thus, enclosure 12 is gas tight.

Enclosure 12 includes bushings 42, 44 for supporting electrodes or conductors 46, 48, respectively. Bushings 42, 44 are brazed in end covers 24, 26, respectively. Supply conductor 46 extends through bushing 42 and load conductor 48 extends through bushing 44. Bushings 42, 44 form hermetic seals with conductors 46, 48. Current conductors 46, 48 are stationary conductors made of a conductive metal, such as copper. Conductors 46, 48 each engage a fitting (not shown) to join a power cable of an external distribution network.

A pair of switch contacts 62, 76 are disposed within upper chamber 18. Contacts 62, 76 have contact points formed from copper-impregnated tungsten. Stationary contact 62 is disposed on the terminal end of conductor 46. Moveable contact 76 is mounted on a contact support 74. Conductor 48 includes a cantilever conductor beam 64, preferably made of a high-conductivity copper such as CD 101. Beam 64 is welded or brazed to the terminal end of conductor 48. Beam 64 is flexible and is received within a rectangular cross-sectioned aperture 84 in contact support 74. Beam 64 is also rectangular in cross-section and is slidingly received within the cross-sectioned aperture 84 of support 74. The sides of aperture 84 and beam 64 prevent beam 64 from rotating within support 74.

When the switch is opened as the movable contact 76 moves away from the stationary contact 62 to open the switch, a circuit-interrupting or arcing gap 75 is established between the adjacent ends of the contacts, 62, 76 and the resulting arc, though quickly extinguished, vaporizes some of the metal on the ends of the contacts 62, 76. In order to prevent this metallic vapor from condensing on the internal insulating surfaces within the housing 12 such as on ceramic insulators 30, 32 and 34, vapor shields 50, 52 and 54 are provided to shield the insulators 30, 32, 34 from this metallic vapor and prevent the metal from depositing on the insulators.

Since each vapor shield is of a common construction, a description of vapor shield 50 will also describe vapor shields 52, 54. Vapor shield 50 includes a cylindrical body 56 with a flaring annular cylindrical terminal end 58. End 58 has an enlarged diameter so as to be slidingly received within bore 18. The outside diameter of cylindrical body 56 is sized to be received within the bore 60 formed in insulator 30.

Movable contact 76 is disposed on the end of an actuator stem 72 composed of contact support 74, a ceramic post 78, ferrule 82 and a ceramic draw rod 80. Contact support 74 includes a shallow recess or counterbore at its lower end for receiving the upper end of an insulator shaft or ceramic post 78 and is affixed thereto such as by brazing. Ceramic post 78 extends upwardly to contact support 74. The lower end of ceramic post 78 is received within the bore of a hollow cylindrical metallic ferrule 82 providing an annular flanged seat with which the lower end portion of ceramic post 78 is brazed. Ceramic post 78 is an axially extending dielectric shaft. Ceramic draw rod 80 is brazed to the bottom of ferrule 82. The draw rod 80 must be made of an insulating material or it would short out the switch. Draw rod 80 is insulated behind the contact 76 so as to provide an insulating section to line voltage.

A vapor and field shaping shield 90 is mounted around post 78. Shield 90 includes an upper cup-shaped shield 88 having an aperture therethrough for receiving the lower terminal end of support contact 74. The lower end of contact support 74 is affixed to shield 88 by brazing. A lower upwardly facing cup-shaped shield 89 includes an aperture in which is mounted ferrule 82. Ferrule 82 is brazed to shield 89. Lower shield 89 has a smaller diameter than that of upper shield 88 such that upper shield 88 receives lower shield 89 causing shields 88, 89 to overlap at 92.

Since vapor shields 50, 52, 54 and 90 are directly in the line of sight between contact 62, 76 and ceramic sections 30, 32, 34 and post 78, as the metallized vapor is produced by the high-pressure metal vapor arc, the isotropic scattering from the contact area toward the ceramic sections 30, 32, 34 and post 78 causes the metallic vapor to deposit on vapor shields 50, 52, 54, 90 such that the vaporized metal will never deposit, or only in a very insubstantial amount, on the surfaces of ceramic sections 30, 32, 34 or post 78. Should such metallic vapor deposit on ceramic sections 30, 32, 34 or post 78, a conductive surface will be formed over time which will cause the switch to be destroyed. Vapor shields 88, 89 not only shield vapor but they grade the field.

Aperture 96 is provided in the lower end cap 28 of lower portion of cylindrical housing 14 for receiving an end cup 94. End cup 94 includes a cylindrical section with an end plate 108. The cylindrical body of end cup 94 is received within aperture 96 and extends into the bore of cylindrical insulator 34. End cap 28 is brazed to the cylindrical portion of end cup 94 to hermitically seal cup 94 to end cap 28. An insulator 100 is mounted on the outer periphery of the cylindrical body of end cup 94. Threads 98 are provided on the external surface of end cup 94 for engaging mounting nut 100.

A bellows 102 is mounted within the bore 104 of end cup 94 which serves as a housing for bellows 102. The bellows 102 is slidingly secured at its respective opposite ends to draw rod 80 and end cup 94. The lower end 106 of bellows 102 is brazed to the inside surface of end plate 108. The other end 110 of bellows 102 is affixed, such as by welding or brazing, to a metal guide plate 112 at 122. Guide plate 112 is circular in cross-section so as to be reciprocably received within bore 104 of end cup 94. Guide plate 112 includes an aperture 114 for receiving draw rod 80. End plate 112 is affixed to draw rod 80 such as by welding or brazing. The projecting end of draw rod 80 passes through an aperture 116 in end plate 108 and is brazed to the bottom of ferrule 82 as previously described. Rod 80 is hermetically sealed to plate 112 such that the reciprocation of rod 80 also reciprocates bellows guide plate 112 thereby expanding and contracting bellows 102. The flexible metallic bellows 102 interposed between the end plate 108 of end cap 94 and the moveable draw rod 80 provides a seal about the moveable draw rod and allows for vertical movement thereof without impairing the vacuum inside the housing 12.

The free end 120 of draw rod 80 projects from end plate 108 into an actuator (not shown). Coupled to the lower end 120 of draw rod 80 is provided a suitable actuating means which is capable of driving the draw rod 80 rapidly downwardly from the closed position of the switch 10 to the open position so as to open the switch 10.

The switch of the present invention is typically used with a system with a nominal 27 kv voltage and a continuous current of 400 amperes. The systems voltage is normally 7.2 kv or 15 kv. The switch is capable of fault currents of up to 3,000–4,000 amperes. In operation, a current may flow in either direction through conductors 46, 48, i.e., conductor can act either as a load or feeder. In the closed position, contact 76 is in its upper position in electrical engagement with stationary contact 62. Current is conducted through contacts 62, 76 via conductors 46, 48. Upon command, the actuator (not shown) actuates actuator stem 72 downwardly causing moveable contact 76 to move downwardly and away from stationary contact 62. As contacts 62, 76 are disengaged and interrupt circuit flow, an are 75 occurs between contact 62, 76. Although metallic vapor products are formed resulting from the electrical arcing across the open switch contacts 62, 76, vapor shields 50, 52, 54, 90 shield the interior of housing 12 from the deposits of this metallic vapor. As actuator stem 72 moves contact 76 downwardly, beam 64 flexes downwardly. Upon the extinguishment of the arc 75, there is a stand off of the voltage and the circuit is opened. An advantage of the present invention is that should the beam 64 connected to terminal 46 fail or break, such as due to fatigue, the break will occur within the vacuum housing 12 and will act like an open circuit.

Figure 2:
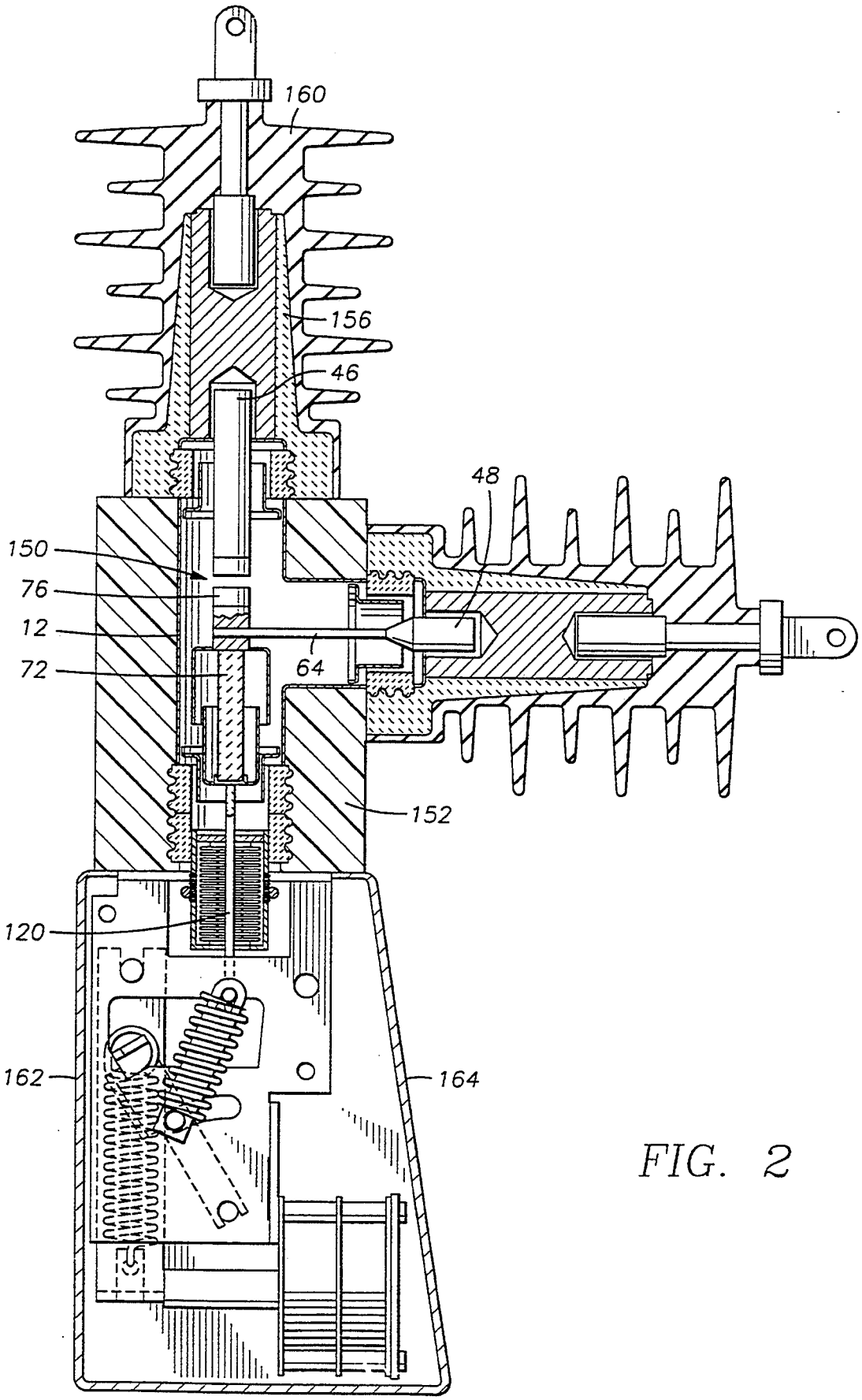
FIG. 2 is a cross-sectional elevation view of the vacuum switch of FIG. 1 in a high-voltage vacuum interrupter.

Referring now to FIG. 2, vacuum switch 10 is shown being used in a high-voltage vacuum-type circuit interrupter 150. The metal/ceramic enclosure 12 is molded in a cycloaliphatic epoxy mold 152. ANSI bushing interfaces 154, 156 are disposed around conductors 48, 46, respectively. Air insulators 158, 160 are disposed over bushing interfaces 154, 156, respectively. Actuator stem 72 is substantially all housed within enclosure 12 with the exception of free end 120 which extends into actuator 162. Actuator stem 72 acts as a line to ground insulating rod. The vacuum interrupter 150 is shown mounted on the top of the housing 164 of actuator 162. Cantilever beam 64 provides a built-in current path between moveable contact 76 and conductor 48.

The vacuum switch 10 of the present invention may be used in many applications. The switch may be used for capacitor switching or for sectionalizing a line or system of switches. The vacuum switch 10 can be molded into a "loadbreak" elbow connector to interrupt currents in medium voltage distribution systems. The switch may also be molded into a solid insulator or be used in an enclosure under oil. The vacuum switch can be used in either a single-phase or a three-phase system.

While a preferred embodiment of the invention has been shown and described, modifications thereof can be made by one skilled in the art without departing from the spirit of the invention.

I claim:

1. A vacuum switch for opening and closing a circuit between first and second electrical power lines, comprising:

a housing having an evacuated chamber;

a first electrical terminal extending into said chamber of said housing and adapted to be connected to the first electrical power line;

a second electrical terminal extending into said chamber of said housing and adapted to be connected to the second electrical power line, said second terminal extending transversely of said first terminal;

said first and second terminals being fixed to said housing and maintained in a stationary position;

a stationary switch contact disposed on said first terminal within said chamber;

a movable switch contact disposed within said chamber on an actuator member providing line to ground insulation reciprocably mounted in said housing;

said second terminal including a flexible conductive member housed within said chamber and electrically connecting said movable switch contact and said second terminal;

said flexible conductive member flexing between a closed circuit position with said movable switch contact engaging said stationary switch contact and an open circuit position with said movable switch contact out of engagement with said stationary switch contact.

2. The switch of claim 1 wherein said housing includes first, second and third end members to which are mounted said first terminal, second terminal, and actuator member, respectively.

3. The switch of claim 2 wherein said housing includes a body portion with insulators between said body portion and said end members.

4. The switch of claim 1 wherein said flexible conductive member includes a conductive rod having one end affixed to said second terminal and another end affixed to said movable switch contact.

5. A vacuum switch for opening and closing a circuit between first and second electrical power lines, comprising:

a housing;

a first electrical terminal extending into said housing and adapted to be connected to the first electrical power line;

a second electrical terminal extending into said housing and adapted to be connected to the second electrical power line said second terminal extending transversely of said first terminal;

said first and second terminals being fixed to said housing and maintained in a stationary position;

a stationary switch contact disused on said first terminal;

a movable switch contact disposed on an actuator member reciprocably mounted in said housing;

said second terminal including a flexible conductive member electrically connecting said movable switch contact and said second terminal;

said flexible conductive member flexing between a closed circuit position with said movable switch contact engaging said stationary switch contact and an open circuit position with said movable switch contact out of engagement with said stationary switch contact;

said housing having first, second and third end members to which are mounted said first terminal, second terminal, and actuator member, respectively;

said housing further including a body portion with insulators between said body portion and said end members; and vapor shields supported within said body portion adjacent said insulators.

6. A vacuum switch for opening and closing a circuit between first and second electrical power lines, comprising:

a housing;

a first electrical terminal extending into said housing and adapted to be connected to the first electrical power line;

a second electrical terminal extending into said housing and adapted to be connected to the second electrical power line, said second terminal extending transversely of said first terminal;

said first and second terminals being fixed to said housing and maintained in a stationary position;

a stationary switch contact disposed on said first terminal;

a movable switch contact disposed on an actuator member reciprocably mounted in said housing;

said second terminal including a flexible conductive member electrically connecting said movable switch contact and said second terminal;

said flexible conductive member flexing between a closed circuit position with said movable switch contact engaging said stationary switch contact and an open circuit position with said movable switch contact out of engagement with said stationary switch contact; and said actuator member includes a draw member extending into said housing and an insulative portion between said movable switch contact and said draw member, said insulative portion insulating said movable switch contact from said draw member.

7. The switch of claim 6 further including a vapor shield surrounding said insulative portion and supported by said actuator member.

8. The switch of claim 7 wherein said vapor shield includes a major diameter cylindrical portion receiving a minor diameter cylindrical portion.

9. The switch of claim 8 wherein said major diameter cylindrical portion is mounted on one end of said insulative portion and said minor diameter cylindrical portion is mounted on another end of said insulative portion.

10. The switch of claim 6 further including a bellows seal having one end affixed to said draw member and another end affixed to said housing.

11. A vacuum switch for opening and closing a circuit between first and second electrical power lines, comprising:

a housing;

a first electrical terminal extending into said housing and adapted to be connected to the first electrical vower line;

a second electrical terminal extending into said housing and adapted to be connected to the second electrical power line, said second terminal extending transversely of said first terminal;

said first and second terminals being fixed to said housing and maintained in a stationary position;

a stationary switch contact disposed on said first terminal;

a movable switch contact disposed on an actuator member reciprocably mounted in said housing;

said second terminal including a flexible conductive member electrically connecting said movable switch contact and said second terminal;

said flexible conductive member flexing between a closed circuit position with said movable switch contact engaging said stationary switch contact and an open circuit position with said movable switch contact out of engagement with said stationary switch contact;

said flexible conductive member including a conductive rod having one end affixed to said second terminal and another end affixed to said movable switch contact;

said movable switch contact including a support member having an aperture receiving one end of said conductive rod.

12. The switch of claim 11 wherein said conductive rod has flattened sides and said aperture is formed by flat wails whereby upon said aperture receiving said rod, said rod cannot rotate within said aperture.

* * * * *